United States Patent [19]

Tomii et al.

[11] Patent Number: 4,745,344

[45] Date of Patent: May 17, 1988

[54] FLAT PLATE-SHAPED CATHODE RAY TUBE

[75] Inventors: Kaoru Tomii, Isehara; Hiroshi Miyama, Yokohama; Yoshikazu Kawauchi, Kawasaki; Jun Nishida, Tokyo, all of Japan

[73] Assignee: Matsushita Electric Industrial Co., Ltd., Kadoma, Japan

[21] Appl. No.: 795,490

[22] Filed: Nov. 6, 1985

[30] Foreign Application Priority Data

Nov. 6, 1984 [JP] Japan ..... 59-233636
Nov. 6, 1984 [JP] Japan ..... 59-233649
Nov. 6, 1984 [JP] Japan ..... 59-233650

[51] Int. Cl.[1] ..... H01J 29/70

[52] U.S. Cl. ..... 315/366; 315/383; 358/67

[58] Field of Search ..... 358/67, 68, 69; 315/366, 370, 371, 383

[56] References Cited

U.S. PATENT DOCUMENTS

| | | | |
|---|---|---|---|
| 3,939,486 | 2/1976 | Tomii | 358/67 |
| 4,163,971 | 8/1979 | Morin et al. | 315/366 |
| 4,174,523 | 11/1979 | Marlowe et al. | 358/67 |
| 4,223,344 | 9/1980 | Hosono et al. | 358/67 |
| 4,259,612 | 3/1981 | Christiano et al. | 315/366 |
| 4,360,826 | 11/1982 | Miyazaki et al. | 315/371 |
| 4,449,148 | 1/1982 | Inohara et al. . | |
| 4,451,846 | 5/1984 | Iyehara et al. | 315/366 |

*Primary Examiner*—Theodore M. Blum
*Assistant Examiner*—David Cain
*Attorney, Agent, or Firm*—Cushman, Darby & Cushman

[57] ABSTRACT

An electron beam detecting electrode is provided laterally outside an effective picture area, to detect a beam current amount and vertical position of the electron beam. An amount of the electron beam current and a position of the electron are controlled by utilizing an output signal of the electron beam detecting electrode, and a uniform brightness and a uniform distance between horizontal scanning lines are obtainable.

34 Claims, 11 Drawing Sheets

FLAT PLATE-SHAPED CATHODE RAY TUBE

FIELD OF THE INVENTION AND RELATED ART STATEMENT

1. Field of the Invention

The present invention relates to a flat plate-shaped cathode ray tube.

2. Description of the Related Art

Hitherto, a conventional flat plate-shaped cathode ray tube has been proposed, for example, in U.S. Pat. No. 4,449,148. Such a structure is shown in FIG. 1. In FIG. 1, back electrode 1, filament-cathodes 2 as electron beam sources, a beam extracting electrode 3, vertical focussing and deflection electrodes 4, a first shield electrode 5, electron beam current control electrodes 6, a second shield electrode 7, horizontal focussing and deflection electrodes 8, a third shield electrode 9, electron beam accelerating electrodes 10 and a screen 11 are disposed from behind to front in that order. The filament-cathode 2, as the electron beam source is span a horizonal direction, so as to produce electron beams distributed in a line shape in a horizontal direction. A plural number of such cathodes 2, 2, 2 . . . are disposed at intervals of a predetermined distance in a vertical direction. In the example in FIG. 1, there are 15 of the filament-cathodes 2, 2, . . . The cathode 2 comprises a tungsten wire of, for example, 10 to 20 $\mu$m in a diameter with oxide cathode material coated on its surface. In order to extract an electron beam from the cathode 2 to the beam extracting electrode 3, a potential of the back electrode 1 is kept lower than that of the cathode 2 and the potential of the beam extracting electrode 3 kept higher than that of the cathode 2. The electron beam emitted from the cathode 2 advances to a region of the vertical focussing and deflection electrode 4 through an opening 3' of the beam extracting electrode 3. The plural number of vertical focussing and deflection electrodes 4, 4, . . . are disposed between the openings 3', 3', . . . of the beam extracting electrode 3. The vertical focussing and deflection electrode 4 focuses the electron beam in a vertical direction, using an electrostatic lens formed by a first shield electrode 5 and the vertical focussing and deflection electrode 4. Further, a vertical deflection voltage is impressed between the facing vertical focussing and deflection electrodes 4, 4, . . . , thereby to deflect the electron beam vertically. In the example, the electron beam from one piece of the cathode 2 is deflected in a vertical direction to as many positions as sixteen horizontal lines. Therefore, when all of the fifteen numbers of cathodes 2 are driven, the electron beams are deflected so as to produce 240 horizontal lines on the screen 11.

The electron beam current control electrode 6 comprises plural electric conductive plates 62, 62, disposed in a horizontal direction with adequate spaces. The electric conductive plate 62 of the control electrode 6 divides each electron beam into each picture element and takes it out and also controls its transmission amount therethrough responding to the video signal for displaying each picture element. When a plural number of 320 pieces of the control electrode 6 are set, 320 picture elements can be displayed every one horizontal line. Further, for displaying a picture with colors, respective picture elements are to be displayed with phosphors of three colors of R, G or B, and to respective control electrodes 6, responding to video signals of R, G and B are sequentially applied. And to the 320 control electrodes 6, video signals of 320 sets which are corresponding to one line are applied at one time, thereby the picture image on one line is displayed at one time.

The first, second and third shield electrodes 5, 7, 9 are electrically conductive plates having a plural number of vertically oblong slits responding to the slits of the control electrodes 6.

The accelerating electrodes 10 are constituted with plural electric conductor plates which are disposed in the horizontal direction at the same position as those of the vertical focussing and deflection electrode 4, which accelerate the electron beams and at the same time have a magnifying effect of the vertical deflection.

The screen 11 is structured in a manner that phosphors 20 for emitting light by the illumination of the electron beams are coated on an inside surface of a glass plate 21 and a metal-back layer (not shown) is formed further thereon. As for the phosphors 20, for each of slits of the control electrode 6, that is, for each electron beam which is divided in the horizontal direction, phosphors of three colors R, G and B, as a set, are provided and are coated in a stripe manner in the vertical direction. In FIG. 1, lateral dotted broken lines drawn in the screen 11 show divisions in the vertical direction which are displayed in responding to each of a plural number of filament-cathode 2, and vertical dotted broken lines show divisions in the horizontal direction which are displayed in responding to each of a plural number of the control electrode 6.

Advantageous feature of the above-mentioned flat plate-shaped cathode ray tube, is that it composes a whole picture on the screen by deflecting the electron beam in a horizontal and a vertical direction each block while utilizing the plural number of filament-cathodes and control electrodes.

However, the conventional flat plate-shaped cathode ray tube has a disadvantage that the brightnesses of the blocks are not uniform as compared with each other. Further, the distances between the horizontal lines (scanning lines) are not uniform as compared with each other.

OBJECT AND SUMMARY OF THE INVENTION

The present invention is intended to provide a flat plate-shaped cathode ray tube having uniform brightness and uniform distance between the horizontal scanning lines.

A flat plate-shaped cathode ray tube of the present invention comprises:

a filament-cathode for emitting an electron beam, a back electrode disposed at one side of the filament-cathode, a beam extracting electrode for extracting the electron beam, disposed at the other side of the filament-cathode, a vertical focussing and deflection electrode for focussing and deflecting the electron beam, disposed in front of the beam extracting electrode, plural electrodes disposed in front of the vertical focussing and deflection electrode, a screen disposed in front of the plural electrodes, and an electron beam current detecting electrodes for detecting an amount and/or a position of the electron beam, disposed outside, in a horizontal direction, of an effective picture area of at least one of the plural electrodes.

DESCRIPTION OF THE PREFERRED EMBODIMENTS

The embodiment of the present invention is described as follows.

Figure 1:
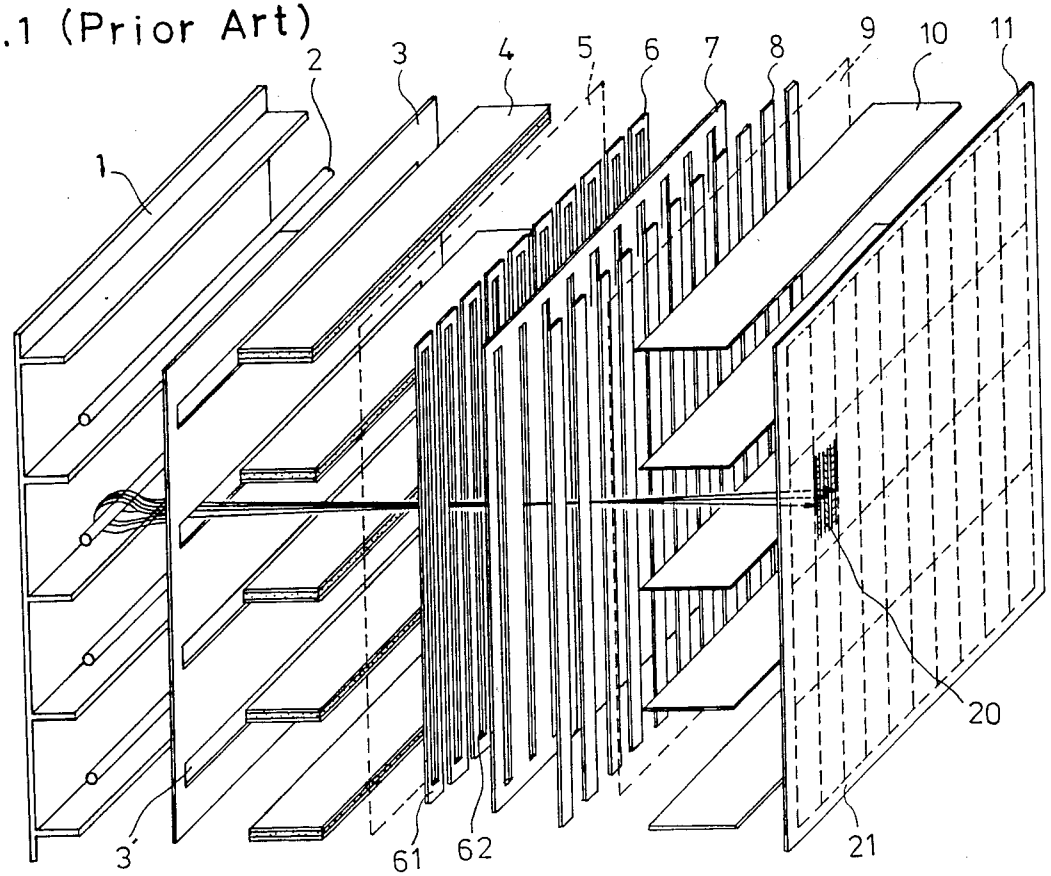
FIG.1 (Prior Art)
FIG. 1 is a perspective view showing an inner fundamental composition of the conventional flat plate-shaped cathode ray tube.
Figure 2:
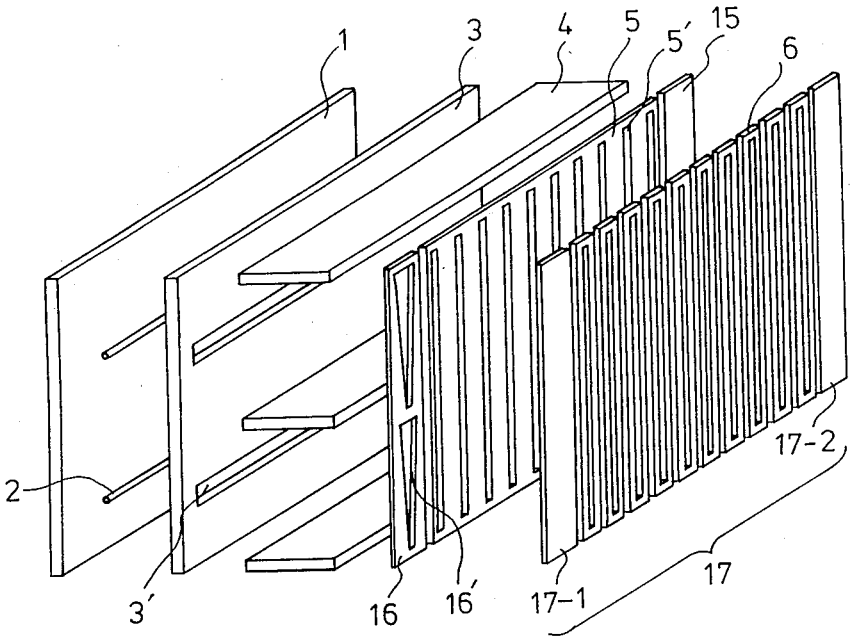
FIG. 2 is a perspective view showing a part of an electrode composition of the flat plate-shaped cathode ray tube of the present invention.

FIG. 2 shows an embodiment of the electrode configuration according to the present invention. The embodiment includes back electrode 1, the filament-cathode 2, the beam extracting electrode 3, the vertical focussing and deflection electrode 4, the first shield electrode 5, the electron beam current control electrodes 6 and beam current detecting electrodes 15, 16, 17. The parts in FIG. 2 corresponding to the parts in FIG. 1 are designated by the same numbers. The beam detecting electrodes 15, 16, 17 are provided laterally outside, namely in a horizontal direction of the screen, corresponding to the position of effective screen area through which an electron beam being controlled by video signals passes as of the first shield electrode 5 and the beam current detecting electrode 6. The beam detecting electrodes 15, 16 are disposed at both sides of the first shield electrode 5. Both side parts, respectively, of the back electrode 1, the filament-cathode 2, the beam extracting electrode 3 and the vertical focussing and deflection electrode 4 extend in a horizontal direction, outside the effective screen area of each electrode. The first beam detecting electrode 15 (beam current detecting electrode) may have a slit or a circular opening. The first beam detecting electrode 15 is electrically isolated from the first shield electrode 5 which is disposed within the effective screen area. The second beam detecting electrode 16 (beam position detecting electrode) is also electrically isolated from the first shield electrode 5 and has cuneiform opening 16' along the vertical scanning area responding to each cathode 2. The third beam detecting electrode 17 is disposed at both sides of the electron beam current control electrode 6 and electrically isolated therefrom. The electron beam current control electrode 6 is disposed within the effective screen area. The third beam detecting electrodes 17-1, 17-2 are disposed facing the first and the second beam detecting electrodes 15, 16.

Figure 3:
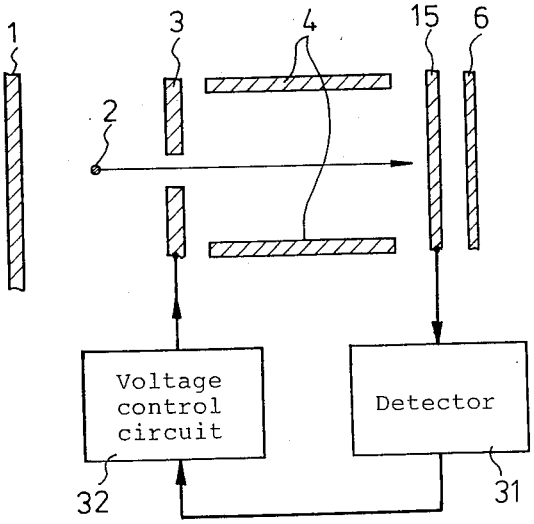
FIG. 3 is a block diagram showing a constant beam current maintenance circuit of the flat plate-shaped cathode ray tube of the present invention.

In the flat plate-shaped cathode ray tube having the above-mentioned composition, an embodiment for making uniform each beam current from each cathode uniform is shown in FIG. 3.

The beam passing through the beam-extracting electrode 3 is focused and deflected by the vertical focussing and deflection electrode 4 and enters the first beam electrode 15. A constant direct current (not controlled by the video signal etc.) enters the first beam detecting electrode 15. The amount of the current detected thereby in a predetermined time period is detected by a detector 31. The detected current is compared with a predetermined current value in the detector 31, and the difference between them is detected and is supplied to a voltage control circuit 32. The voltage control circuit 32 controls the voltage which is to be supplied to the beam extracting electrode 3. Thus, the beam current detected by the first beam detecting electrode 15 is always maintained at a predetermined value. Further, the detecting of the beam current can be executed by the third beam detecting electrode 17-2 (beam current detecting electrode). In a modified embodiment, the beam detecting electrode 15 can be omitted and the first shield electrode 5 including an oblong slit is extended in a horizontal direction to the position where the electrode 15 existed.

By executing the above-mentioned operation for all the cathode regions, uniform brightness is obtained on the whole screen 11.

A method for stabilizing the vertical scanning amplitude and the position of the impinging of the beam on the screen 11 will now be discussed.

Figure 4:
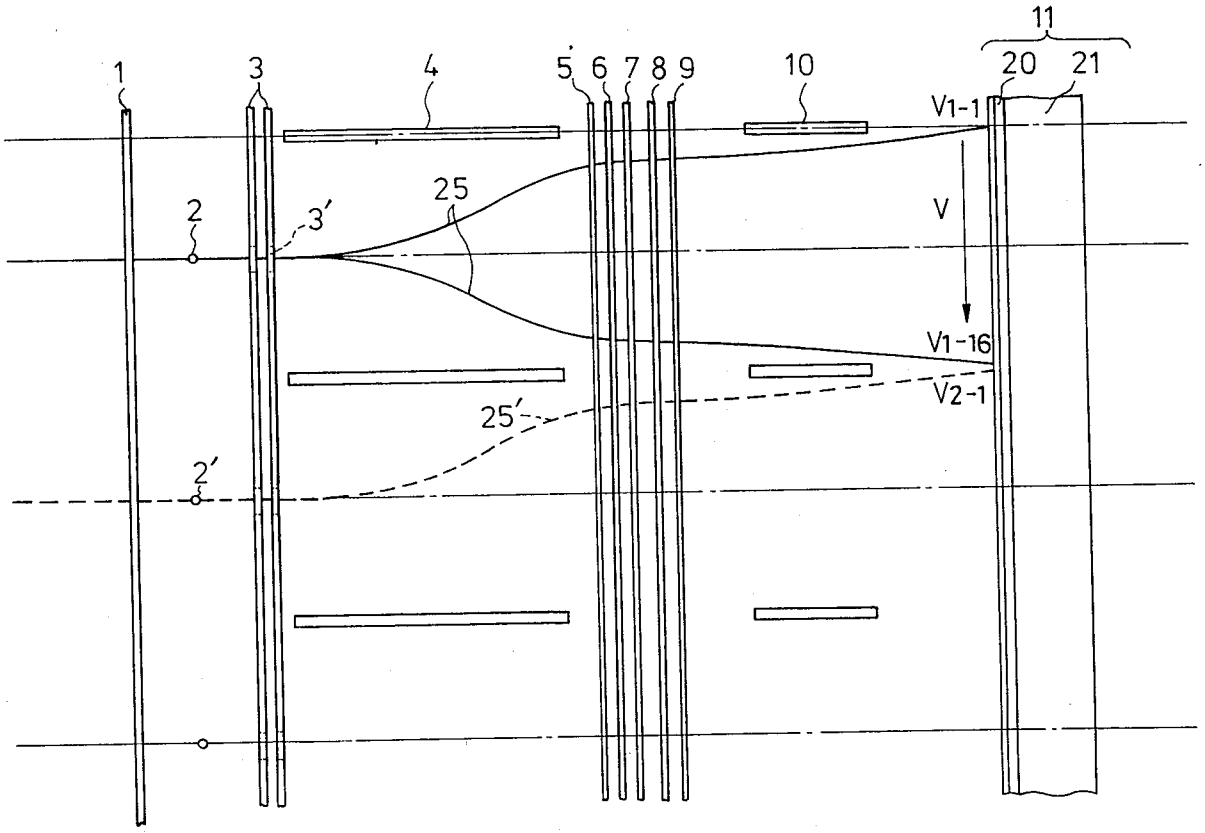
FIG. 4 is a side view showing an embodiment of the flat plate-shaped cathode ray tube of the present invention.

FIG. 4 shows a side view of the constitution in FIG. 1. A locus of the electron beam 25 is obtained when the voltage of the video signal impressed to the electron beam current control electrode 6 is low. In the embodiment, the electron beam 25 from each cathode is deflected into sixteen steps in a vertical direction, as indicated by an arrow V, thereby forming a whole picture while maintaining constant the distance between the scanning line.

The gap or distance between adjacent vertical scanning areas responding to each cathode 2 namely, the distance between the scanning position $V_{1\text{-}16}$ of the electron beam 25 and the scanning position $V_{2\text{-}1}$ of the electron beam 25' in FIG. 4, should be almost the same as one vertical scanning step width in the scanning area.

In order to satisfy the above-mentioned criteria, an amount of the beam which enters the second beam detecting electrode 16 is detected. An amount of the beam which passes through the opening 16' of the second beam detecting electrode 16 and which enters to the third beam detecting electrode 17-1 is detected. By detecting the beam position with the two detected amounts, namely the detected amounts from the second and third detecting beams, the beam is controlled so as to impinge on a correct position of the screen as follows.

Figure 6:
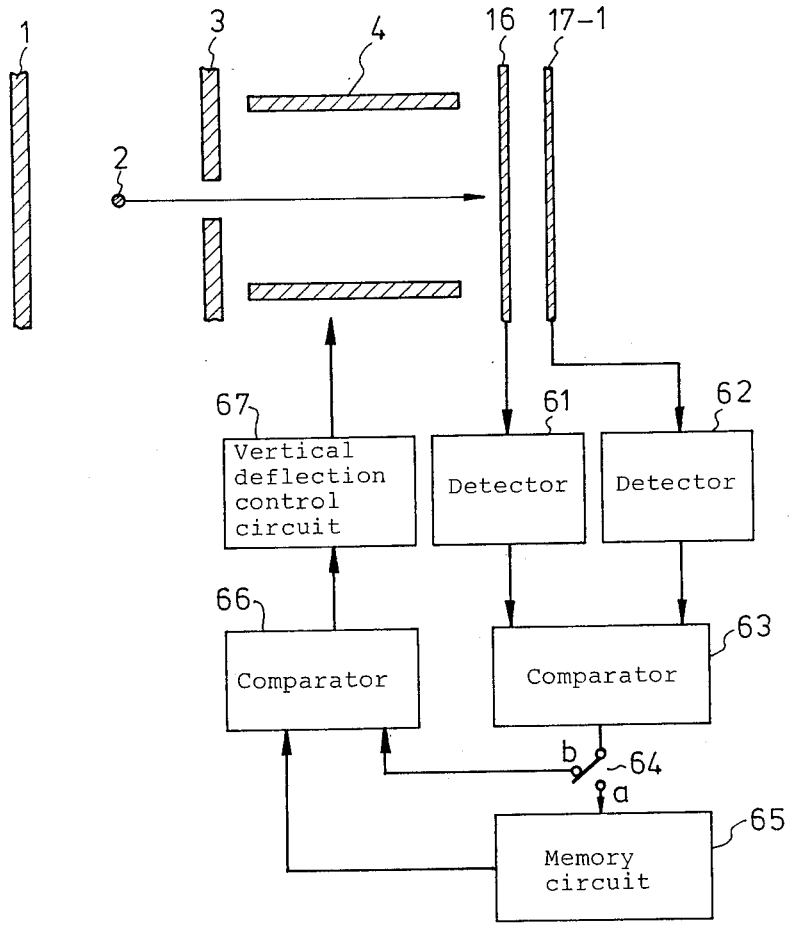
FIG. 6 is a block diagram showing a beam position control circuit of the flat plate-shaped cathode ray tube of the present invention.

An embodiment for satisfying the abovementioned requirement is shown in FIG. 6. The potentials of the above-mentioned various electrodes are adjusted as an initial adjustment so as to make the electron beam impinge on correct positions of the screen. Then, an amount of the beam current entering to the second beam detecting electrode 16, and an amount of the beam current entering to the third beam detecing electrode 17-1 (beam position detecting electrode) are detected by detectors 61 and 62 for every horizontal scanning. The detectors 61, 62 are supplied with a horizontal synchronizing signal. The two amounts of the beam current for every horizontal scanning, is supplied to a comparator 63. The comparator 63 compares the two amounts of the beam current for every horizontal scanning, thereby to obtain the difference or ratio between the two amounts every each horizontal scanning. The obtained difference or ratio is supplied to and memorized in a memory circuit 65 by turning a switch 64 to "a" side.

The second beam detecting electrode 16 has the cuneiform opening 16' as mentioned above. Therefore, when the beam is deflected in a vertical direction, the amount of the beam entering to the second beam detecting electrode 16 and the amount of the beam entering to the third beam detecting electrode 17-1 are different, responding to the deflected positions. Therefore, the difference or the ratio between the two amounts can be corresponding to the impinging position of the beam on the screen.

After the above-mentioned setting, the memory content which is reference of the difference or ratio in the memory 65 are read out to a comparator 66 in synchronism with the vertical and horizontal scanning. Then, by turning the switch 64 to "b" side, the difference or the ratio between the amounts of the beam current entering to the second and third beam detecting electrodes 16, 17-1, is calculated in the comparator 63 and the difference or the ratio is supplied to the comparator 66. The comparator 66 compares the difference or the ratio with the reference of the difference or the ratio. When an inconsistency between the detected difference or the ratio and the reference of the difference or the ratio is produced, a difference between the differences is supplied to a vertical deflection control circuit 67. The vertical deflection control circuit 67 controls the voltage to be supplied to the vertical focussing and deflection electrode 4, so as to compensate the beam position.

Figure 7:
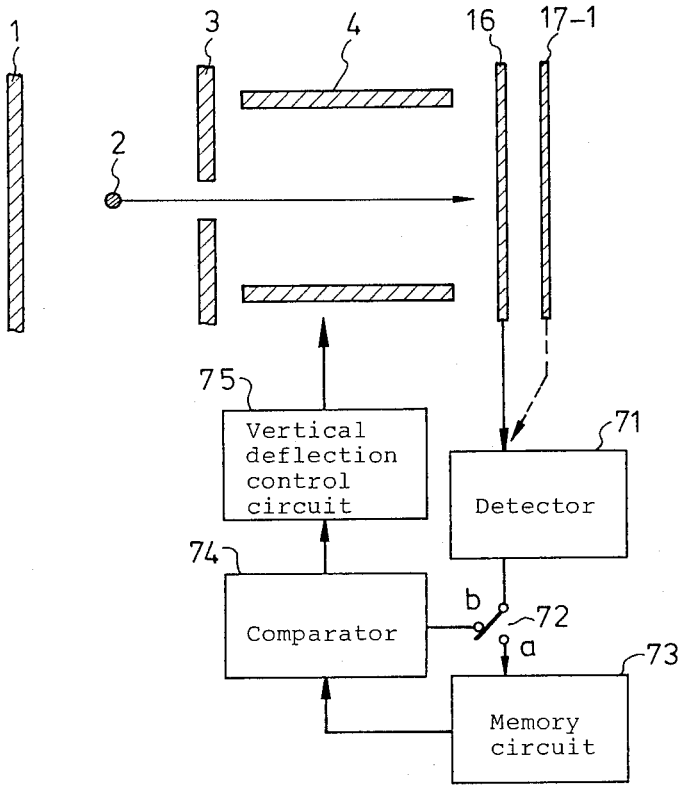
FIG. 7 is a block diagram showing another beam position control circuit of the flat plate-shaped cathode ray tube of the present invention.

FIG. 7 is another embodiment for controlling the electron beam position. When the amount of the beam current entering to the first shield electrode 5 is maintained constant as mentioned with regard to FIG. 3, it is unnecessary to detect the beam current from both electrodes of the second beam detecting electrode 16 and the third beam detecting electrode 17-1 mentioned in the embodiment in FIG. 6; that is, the beam current can be made to be corresponding to the position of the impingement of the beam on the screen 11 by utilizing only either one of the electrodes 16 or 17-1. That is, in the embodiment, the beam current is detected by a detector 71 from one of the second beam detecting electrode 16 and the third beam detecting electrode 17-1. Then, the initial setting as described in the embodiment in FIG. 6, is executed and the output of the detector 71 is memorized as a reference in the memory circuit 73. After the memorization, the terminal "b" of the switch 72 is turned on. Then the comnparator 74 compares the output of the detector 71 with the reference output of the memory circuit 73, and thereby the vertical deflection control circuit 75 is controlled by the output of the comparator 74.

As described in the embodiments of FIG. 6 and FIG. 7, the beam can impinge always on a correct position of the screen by making the beam current, which enters to the beam detecting electrode disposed after the vertical deflection electrode, correspond to the position of the beam impingement on the screen.

Figure 5:
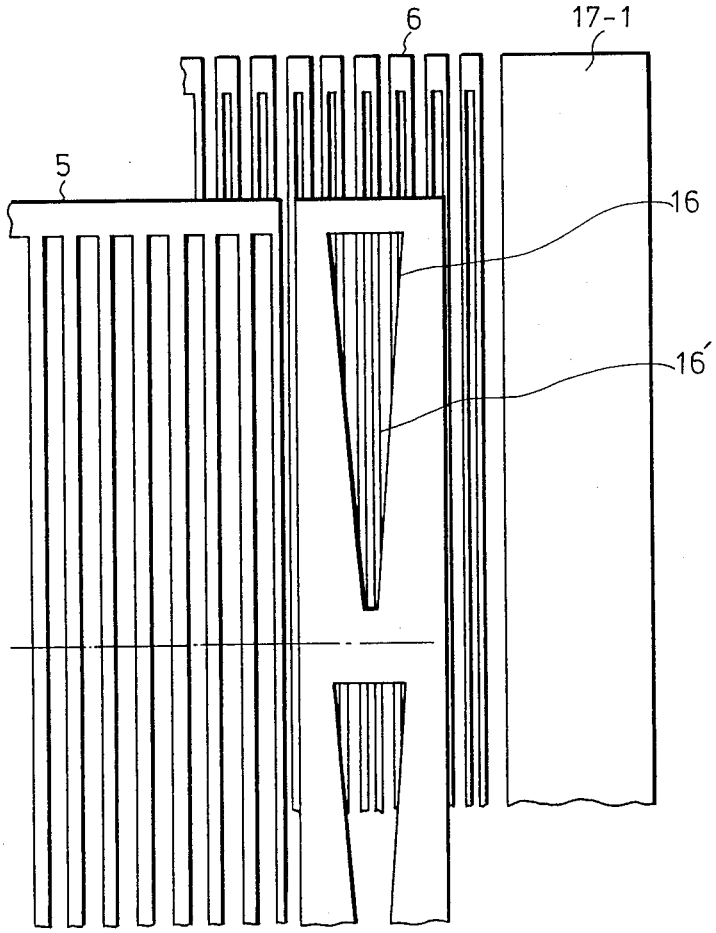
FIG. 5 is a perspective view showing a second and third beam current detecting electrodes in an embodiment of the flat plate-shaped cathode ray tube of the present invention.
Figure 8:
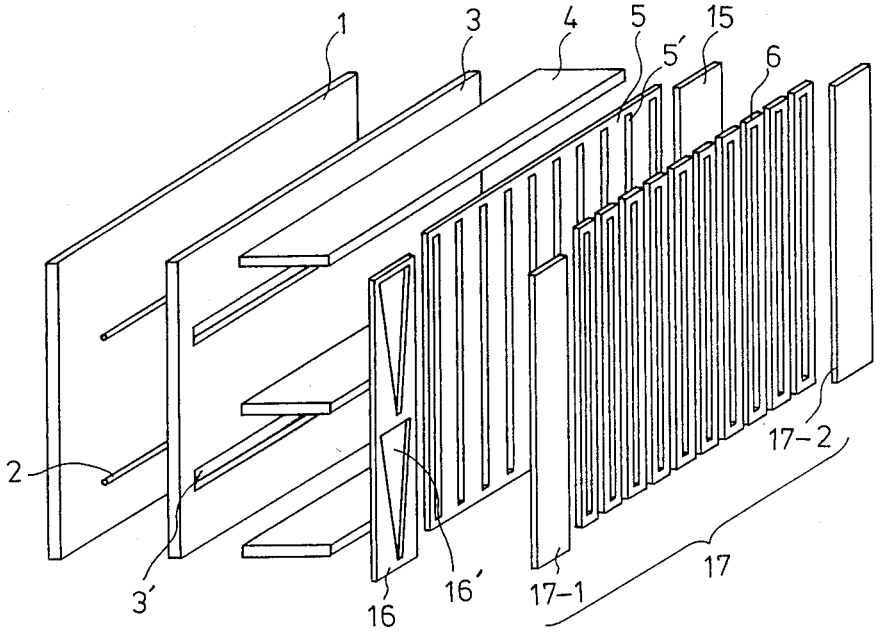
FIG. 8 is a perspective view showing a part of an electrode composition of another embodiment of the flat plate-shaped cathode ray tube of the present invention.
Figure 9:
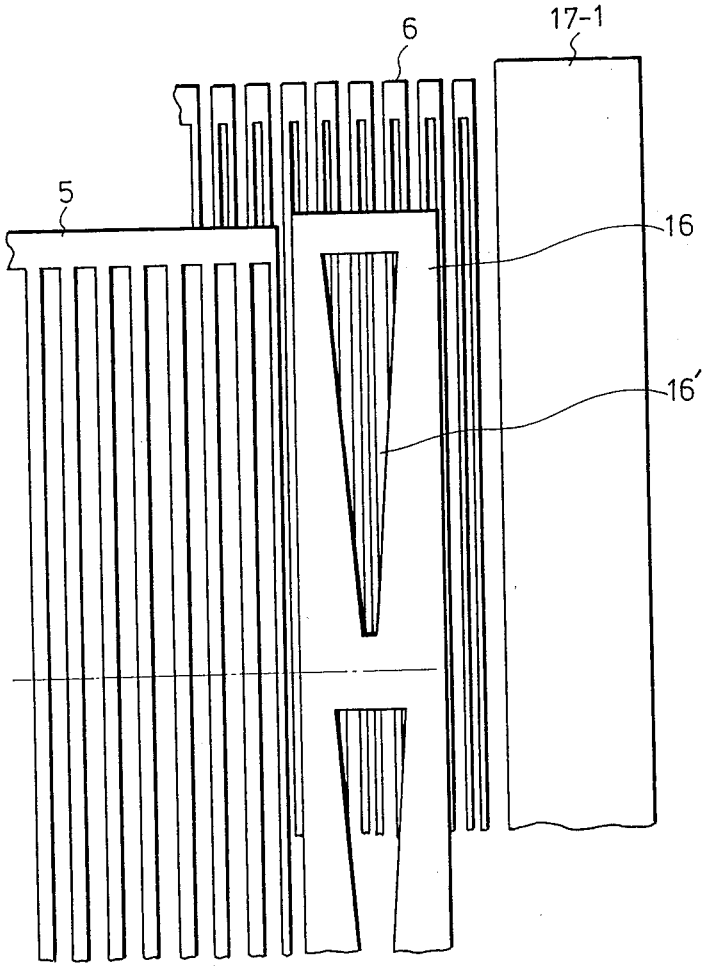
FIG. 9 is a perspective view showing a second and third beam current detecting electrodes in another embodiment of the flat plate-shaped cathode ray tube of the present invention.

FIG. 8 and FIG. 9 show another embodiment of the electrode constitution of the present invention. The parts in FIGS. 8 and 9 corresponding to the parts in FIGS. 2 and 5 are designated by the same numbers. The second beam detecting electrode 16 is separated from the electrode 5 and has the cuneiform opening 16'. The second beam detecting electrode 16 is disposed being shifted from the electrode 5 in the beam transmitting direction. The third beam detecting electrode 17 is separated from the electron beam current control electrode 6 and is facing the first and second beam detecting electrodes 15, 16. The third beam detecting electrode 17 is shifted from the electrode 6 in the beam transmitting direction.

Other parts of the constitution in FIGS. 8 and 9 are same as the constitution in FIGS. 2 and 5. Also, the operation of the system for making the beam current for every cathode uniform and the operation of the method for stabilizing the impinge position of the beam, are same as mentioned in the embodiment in FIGS. 3 to 7.

Figure 10:
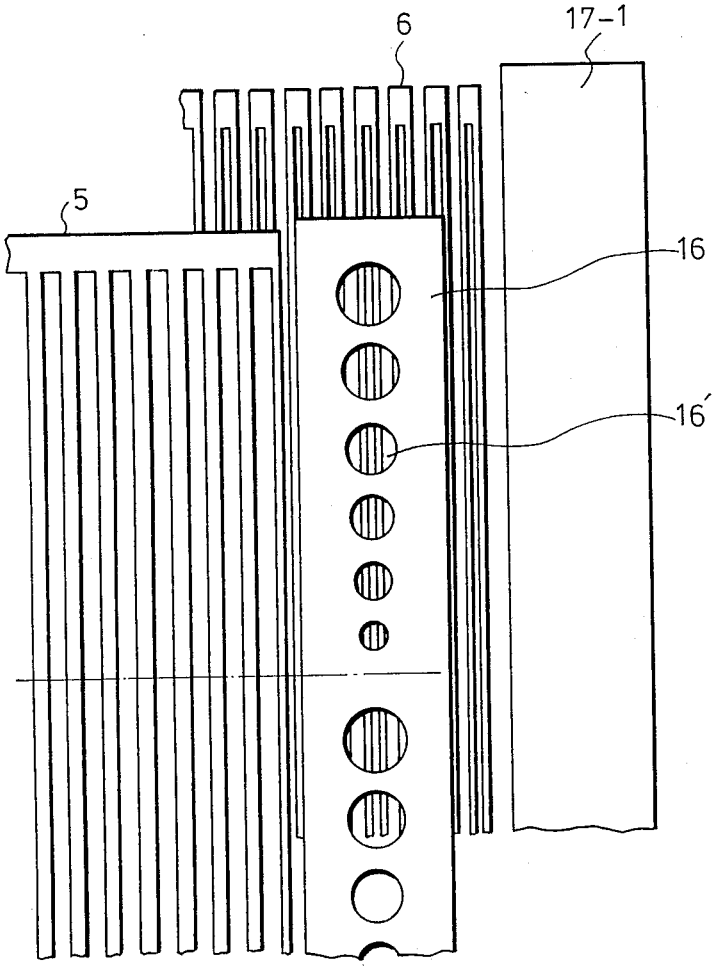
FIG. 10 is a perspective view showing a shape of the opening of the second beam current detecting electrode of the present invention.

The shape of the opening of the second beam detecting electrode 16 is cuneiform in FIGS. 2 and 8. However, the shape of the opening is not restricted to the cuneiform. That is, the shape of the opening can be any shape so long as the entering beam amount varies responding to the vertical scanning of the beam. For example, the opening 16' may comprise various diameter circular holes which are disposed in a beam scanning direction as shown in FIG. 10. Further, the shape of the hole may be ellipse or rectangular so long as the amount of the passing-through beam varies responding to the vertical scanning.

Further, only one of the second beam detecting electrode 16 and the third beam detecting electrode 17 can be shifted from the electrode 5 or the electrode 6.

Figure 11:
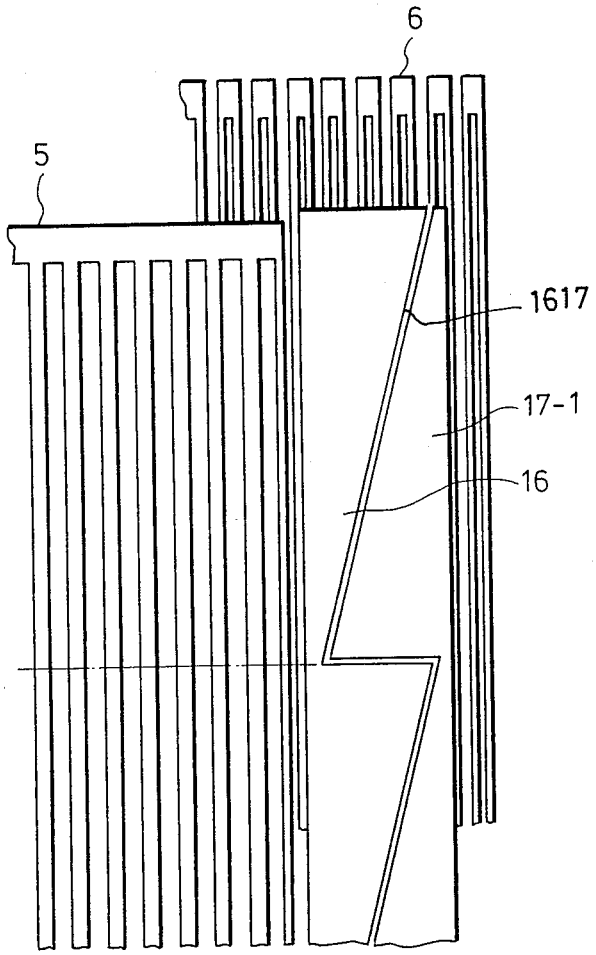
FIG. 11 is a perspective view showing another beam current detecting electrode of the present invention.

In the previous embodiments, the second and third beam detecting electrodes 16, 17-1 are disposed in the beam transmitting direction. However, as shown in FIG. 11, the second and third beam detecting electrodes 16, 17-1 may be disposed outside, in a horizontal direction, of the electrode 5 and may be separated from the electrode 5. The second and third beam detecting electrodes 16, 17-1 are separated from each other and disposed in a same plane. The separation gap 1617 between the second and third beam detecting electrodes 16, 17-1 are incline against a vertical direction. Therefore, the beam currents entering to the beam detecting electrodes 16, 17-1 are detected respectively responding to the vertical deflection. The difference or ratio between the detected beam currents of the beam detecting electrodes 16, 17-1 are calculated by the circuit in FIG. 6, thereby to compensate the position of the impingement of the beam on the screen.

Further, in the above-mentioned embodiments, the beam detecting electrode is provided at the first shield electrode 5 and at the beam current control electrode 6. But the beam detecting electrode can be provided at any positions after the vertical focussing and deflection electrode 4.

As mentioned above, a constant current can be always obtained by controlling the voltage of the beam extracting electrode by detecting the beam current value entering the beam current detecting electrode provided outside of the effective picture area. Thus, a uniform brightness picture can be obtained. Further, the correct position of the impingement of the beam current on the screen can be obtained by controlling the beam position by comparing the detected beam current with a predetermined reference of the beam current.

Figure 12:
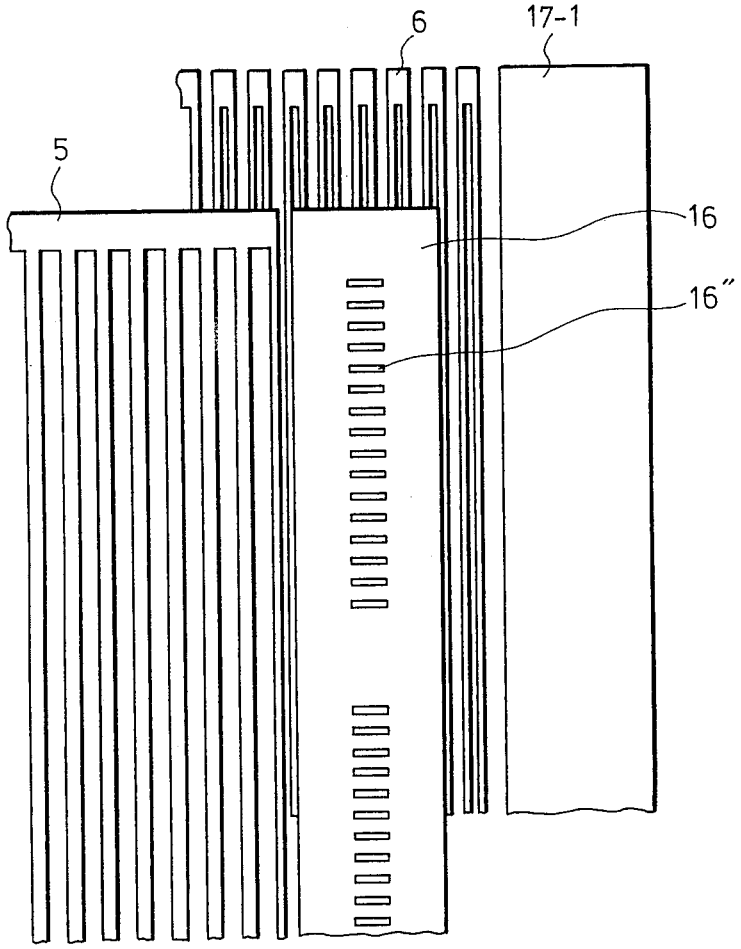
FIG. 12 is a perspective view showing second and third beam current detecting electrodes of another embodiment of the present invention.

FIG. 12 shows another embodiment of the present invention. The parts in FIG. 12 corresponding to the parts in FIG. 9 are designated by the same numbers.

The above-mentioned second beam current detecting electrode 16 has at least the same number of openings 16" as the number of the horizontal scanning lines. The openings are disposed at such position that the beam passed through the openings impinges on a correct position of the screen 11.

What is claimed is:

1. A flat plate-shaped cathode ray tube comprising:

filament-cathode means for emitting an electron beam;

a back electrode disposed at one side of said filament-cathode means;

beam extracting electrode means for extracting said electron beam, disposed at an other side of said filament-cathode means;

vertical focussing and deflecting electrode means for focussing and deflecting said electrode beam, disposed at said other side of said beam extracting electrode means;

a plurality of electrodes disposed at said other side of said vertical focussing and deflection electrode means;

a screen disposed in front of said plurality of electrodes; and electron beam current detecting electrode means for detecting a magnitude of said electron beam, said electron beam current detecting electrode means disposed outside, in a horizontal direction, of an effective picture area, which is an area through which an electron beam controlled by a video signal passes, of at least one of said plurality of electrodes.

2. A flat plate-shaped cathode ray tube in accordance with claim 1, wherein said electron beam current detecting electrode means includes at least two detecting electrode and is separated from said plurality of electrodes, and a rear-most detecting electrode is formed with an opening having a same opening ratio as that of an electrode within the effective picture area.

3. A flat plate-shaped cathode ray tube in accordance with claim 1, wherein said electron beam current detecting electrode means is separated from said plurality of electrodes and said electron beam current detecting electrode has no opening.

4. A flat plate-shaped cathode ray tube in accordance with claim 1, wherein an amount of the electrode beam entering said electron beam current detecting electrode means is detected thereby, and further comprising voltage control means, coupled to receive said signal, for controlling said beam extracting electrode means, and wherein said voltage control means controls said beam extracting electrode means to maintain said amount of said electron beam entering said beam extracting electrode means at a predetermined value.

5. A flat plate-shaped cathode ray tube in accordance with claim 1, wherein an amount of the electron beam entering said electron beam current detecting electrode means is detected and supplied to said back electrode, thereby controlling an amount of said beam from said filament-cathode means.

6. A flat plate-shaped cathode ray tube in accordance with claim 1, further comprising electron beam position detecting electrode means for detecting a position of said electron beam, disposed outside, in a horizontal direction, of at least one of said plurality of electrodes.

7. A flat plate-shaped cathode ray tube in accordance with claim 6, wherein said electron beam position detecting electrode means is separated from said plurality of electrodes and is further separated from said electron beam current detecting electrode means, said electron beam position detecting electrode means comprises at least two detecting electrodes, and an electrode which is a nearest one to said filament-cathode means among said detecting electrodes is formed with aperture means having a shape that width varies thereby to change a beam transport ratio responding to a vertical direction of the beam.

8. A flat plate-shaped cathode ray tube in accordance with claim 6, further comprising:

memory means for storing in advance an output of said electron beam position detecting electrode means when said electron beam impinges to a correct position of said screen; and comparator means for comparing an output of said memory means with an output of said electron beam position detecting electrode means, thereby to control said vertical focussing and deflection electrode means to make said electron beam impinge on a correct position of said screen.

9. A flat plate-shaped cathode ray tube comprising:

a filament cathode for emitting an electron beam;

a back electrode disposed at one side of said filament cathode;

a beam extracting electrode for extracting said electron beam, disposed at an other side of said filament cathode;

a vertical focussing and deflection electrode for focussing and deflecting said electron beam, disposed at said other side of said beam extracting electrode;

plural electrodes disposed at said other side of said vertical focussing and deflection electrode;

a screen disposed in front of said plural electrodes, and at least one electron beam position detecting electrode for detecting a position of said electron beam, said at least one electron beam position detecting electrode disposed outside, in a horizontal direction, of an effective picture area, through which an electron beam being controlled by video signals passes, of at least one of said plural electrodes, and separated from said plural electrodes.

10. A flat plate-shaped cathode ray tube in accordance with claim 9, further comprising memory means for storing in advance an output of said at least one electron beam position detecting electrodes when said electron beam impinges to a correct position of said screen; and comparator means for comparing an output of said memory means with an output of said at least one electron beam position detecting electrode, to thereby control said vertical focussing and deflection electrode to make said electron beam impinge on a correct position of said screen.

11. A flat plate-shaped cathode ray tube in accordance with claim 9, wherein said electron beam position detecting electrode is formed with aperture means having such a shape that width varies thereby to change a beam transparent ratio responding to a vertical direction of the beam.

12. A flat plate-shaped cathode ray tube in accordance with claim 9, wherein said electron beam position detecting electrode is disposed outside, in a horizontal direction, of effective picture areas of at least two electrodes of said plural electrodes.

13. A flat plate-shaped cathode ray tube in accordance with claim 12, wherein a rear-most electrode has same number of openings in a vertical direction as a number of horizontal scanning lines.

14. A flat plate-shaped cathode ray tube comprising:

a filament-cathode for emitting an electron beam;

a back electrode disposed at one side of said filament-cathode;

a beam extracting electrode for extracting said electron beam and producing a signal indicative thereof, disposed at an other side of said filament-cathode;

a vertical focussing and deflection electrode for focussing and deflecting said electron beam, disposed at said other side of said vertical focussing and deflection electrode;

plural electrodes disposed at said other side of said vertical focussing and deflection electrode;

a screen disposed at said other side of said plural electrodes;

a vacuum enclosure enclosing said filament cathode, back electrode, beam extracting electrode, focussing and deflection electrode, plural electrode and screen;

at least one electron beam detecting electrode for detecting a magnitude of said electron beam, disposed outside, in a horizontal direction, of an effective picture area, which is an area through which an electron beam controlled by a video signal can pass, of at least one of said plural electrodes, and disposed being shifted from said plural electrodes in an electron beam transmitting direction and separated from said plural electrodes.

15. A flat plate-shaped cathode ray tube in accordance with claim 14, wherein said electron beam detecting electrode is an electron beam position detecting electrode for detecting a position of said electron beam deflected in a vertical direction.

16. A flat plate-shaped cathode ray tube in accordance with claim 15, wherein there are a plurality of electron beam detecting electrodes and an electrode which is a nearest one to said filament-cathode among said plurality electron beam position detecting electrodes is formed with aperture means having such a shape that width varies thereby to change beam transparent ratio responding to a vertical direction of the beam.

17. A flat plate-shaped cathode ray tube in accordance with claim 15, wherein said electron beam position detecting electrode comprises a rear and a front electrode, which are separated electrically and are spaced in said electron beam transmitting direction, said rear electrode having an opening for passing through said electron beam and said front electrode having no opening.

18. A flat plate-shaped cathode ray tube in accordance with claim 14, wherein said electron beam detecting electrode is an electron beam current detecting electrode for detecting an amount of the electron beam for each cathode.

19. A flat plate-shaped cathode ray tube in accordance with claim 18, wherein a rear-most electron beam current detecting electrode has an opening having same opening ratio as that of the electrode within the effective picture area.

20. A flat plate-shaped cathode ray tube in accordance with claim 18, wherein said electron beam current detecting electrode has no opening.

21. A flat plate-shaped cathode ray tube in accordance with claim 14, wherein said electron beam detecting electrode comprises an electron beam current detecting electrode and an electron beam position detecting electrode, both electrodes being enclosed in said vacuum enclosure.

22. A flat plate-shaped cathode ray tube in accordance with claim 14, further comprising voltage control means for detecting an amount of the electron beam entering said at least one electron beam current detecting electrode and for controlling said beam extracting electrode to maintain a predetermined value.

23. A flat-shaped cathode ray tube in accordance with claim 14, further comprising memory means for storing in advance an output of said electron beam position detecting electrode when said electron beam impinges to a correct position of said screen; and comparator means for comparing an output of said memory means with the output of said at least one beam position detecting electrode, thereby to control said vertical focussing and deflection electrode to make said electron beam impinge on a correct position of said screen.

24. A flat plate-shaped cathode ray tube comprising:

a filament-cathode for emitting an electron beam;

a back electrode disposed at one side of said filament-cathode;

a beam extracting electrode for extracting said electron beam, disposed at another side of said filament-cathode;

a vertical focussing and deflection electrode for focussing and deflecting said electron beam, disposed in front of said beam extracting electrode;

plural electrodes disposed in front of said vertical focussing and deflection electrode;

a screen disposed in front of said plural electrodes;

an electron beam current detecting electrode for detecting an amount of said electron beam, disposed outside, in a horizontal direction, of an effective picture area of at least one of said plural electrodes, said effective picture area being an area through which an electron beam controlled by a video signal can pass;

an electron beam position detecting electrode, disposed outside, in a horizontal direction, of at least one of said plural electrodes;

said electron beam position detecting electrode is separated from said plural electrodes and further separated from said electron beam current detecting electrode, and an electrode which is a nearest electrode to said filament-cathode among said electron beam position detecting electrodes has aperture means having such a shape that its width varies thereby to change a beam transparent ratio responding to a vertical direction of the beam.

25. A flat plate-shaped cathode ray tube comprising:

a filament-cathode for emitting an electron beam;

a back electrode disposed at one side of said filament-cathode;

a beam extracting electrode for extracting said electron beam, disposed at another side of said filamentcathode;

a vertical focussing and deflection electrode for focussing and deflecting said electron beam, disposed in front of said beam extracting electrode;

plural electrodes disposed in front of said vertical focussing and deflection electrode;

a screen disposed in front of said plural electrodes;

an electron beam current detecting electrode for detecting an amount of said electron beam, disposed outside, in a horizontal direction, of an effective picture area of at least one of said plural electrodes, said effective picture area being an area through which an electron beam controlled by a video signal can pass;

an electron beam position detecting electrode, disposed outside, in a horizontal direction, of at least one of said plural electrodes;

a memory circuit which beforehand memorizes an output of said electron beam position detecting electrode when said electron beam impinges to a correct position of said screen; and a comparator which compares an output of said memory circuit with an output of said beam position detecting electrode, thereby to control said vertical focussing and deflection electrode to make said electron beam impinge on a correct position of said screen.

26. A flat plate-shaped cathode ray tube comprising:

a filament-cathode for emitting an electron beam;

a back electrode disposed at one side of said filament-cathode;

a beam extracting electrode for extracting said electron beam, disposed at another side of said filamentcathode;

a vertical focussing and deflection electrode for focussing and deflecting said electron beam, disposed in front of said beam extracting electrode;

plural electrodes disposed in front of said vertical focussing and deflection electrode;

a screen disposed in front of said plural electrode;

an electron beam position detecting electrode for detecting a position of said electron beam, disposed outside, in a horizontal direction, of an effective picture area of at least one of said plural electrodes and separated from said plural electrodes, said effective picture area being an area through which an electron beam controlled by a video signal can pass;

a memory circuit which beforehand memorizes an output of said electron beam position detecting electrodes when said electron beam impinges to a correct position of said screen; and a comparator which compares an output of said memory circuit with an output of said beam position detecting electrode, thereby to control said vertical focussing and deflection electrode to make said electron beam impinge on a correct position of said screen.

27. A flat plate-shaped cathode ray tube in accordance with claim 26, wherein said electron beam position detecting electrode has aperture means having such shape that width varies thereby to change beam transparent ratio responding to a vertical direction of the beam.

28. A flat plate-shaped cathode ray tube in accordance with claim 26, wherein said electron beam position detecting electrode is disposed outside, in a horizontal direction, of effective picture areas of at least two electrodes of said plural electrodes.

29. A flat plate-shaped cathode ray tube in accordance with claim 28, wherein a rear-most electrode has a same number of openings in a vertical direction as a number of horizontal scanning lines.

30. A flat plate-shaped cathode ray tube comprising:

a filament-cathode for emitting an electron beam;

a back electrode disposed at one side of said filament-cathode;

a beam extracting electrode for extracting said electron beam, disposed at the other side of said filamentcathode;

a vertical focussing and deflection electrode for focussing and deflecting said electron beam, disposed in front of said beam extracting electrode;

plural electrodes disposed in front of said vertical focussing and deflection electrode;

a screen disposed in front of said plural electrodes;

a vacuum enclosure enclosing said above-mentioned members; and at least an electron beam current detecting electrode disposed outside, in a horizontal direction, of an effective picture area of at least one of said plural electrodes and disposed being shifted from said plural electrodes in an electron beam transmitting direction and separated from said plural electrodes, said effective picture area being an area through which an electron beam controlled by a video signal can pass;

wherein said electron beam detecting electrode is an electron beam position detecting electrode for detecting a position of said electron beam deflected in a vertical direction, and wherein an electrode which is a nearest electrode to said filament-cathode among said electron beam position detecting electrodes has aperture means having such shape that width varies thereby to change beam transparent ratio responding to a vertical direction of the beam.

31. A flat plate-shaped cathode ray tube in accordance with claim 30, wherein said electron beam position detecting electrode comprises two electrodes which are separated electrically and are spaced in the electron beam transmitting direction, a rear electrode having an opening for passing through said electron beam and a front electrode having no opening.

32. A tube as in claim 1 wherein an entirety of the electron beam current detecting electrode means is located outside of said effective picture area, and said effective picture area includes all locations where said electron beam could possibly be controlled to be located as controlled by said video signal.

33. A tube as in claim 9 wherein an entirety of the electron beam current detecting electrode is located outside of said effective picture area, and said effective picture area includes all locations where said electron beam could possibly be controlled to be located as controlled by said video signal.

34. A tube as in claim 14 wherein an entirety of the electron beam current detecting electrode is located outside of said effective picture area, and said effective picture area includes all locations where said electron beam could possibly be controlled to be located as controlled by said video signal.

* * * * *